US010907918B2

(12) United States Patent
Curry

(10) Patent No.: US 10,907,918 B2
(45) Date of Patent: Feb. 2, 2021

(54) CARTRIDGE EXTRACTOR

(71) Applicant: Smith & Wesson Inc., Springfield, MA (US)

(72) Inventor: Brett Curry, Monson, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/776,992

(22) Filed: Jan. 30, 2020

(65) Prior Publication Data

US 2020/0300567 A1 Sep. 24, 2020

Related U.S. Application Data

(60) Provisional application No. 62/821,065, filed on Mar. 20, 2019.

(51) Int. Cl.
*F41A 15/14* (2006.01)

(52) U.S. Cl.
CPC ..... *F41A 15/14* (2013.01)

(58) Field of Classification Search
CPC ..... F41A 15/12; F41A 15/14
See application file for complete search history.

(56) References Cited

U.S. PATENT DOCUMENTS 1,544,566 A * 7/1925 Eickhoff ..... F41A 15/14 42/25
2,591,733 A * 4/1952 Simpson ..... F41A 15/14 42/25
3,882,625 A 5/1975 Iellie
3,967,404 A 1/1976 Reynolds
3,942,277 A * 3/1976 Atchisson ..... F41A 15/14 42/25
4,676,017 A 6/1987 Hurlemann et al.
5,678,340 A * 10/1997 Moon ..... F41A 15/12 42/25
6,145,234 A 11/2000 Fluhr
6,349,495 B1 2/2002 Fluhr
7,827,720 B1 11/2010 Erdem
8,984,787 B1 * 3/2015 O'Clair ..... F41A 15/14 42/25
9,625,231 B1 4/2017 Hass
2005/0115127 A1 * 6/2005 Szabo ..... F41A 15/14 42/46
2012/0167427 A1 * 7/2012 Zukowski ..... F41A 15/14 42/25

(Continued)

FOREIGN PATENT DOCUMENTS

DE 334448 3/1921
DE 695924 C * 9/1940 ..... F41A 15/14

(Continued)

*Primary Examiner* — Gabriel J. Klein
(74) *Attorney, Agent, or Firm* — John A. Chionchio, Esq.; Ballard Spahr LLP

(57) ABSTRACT

An extractor for a semiautomatic firearm has an elongated strap with a hook at one end and a projection at an opposite end. The hook engages the rim of a chambered cartridge and the projection is received within a recess in the slide. A notch in the strap engages a pin in the slide to retain the extractor. One end of a leg is attached to the strap near the hook, the opposite end of the leg engages the slide. The leg acts as a biasing spring to bias the hook into engagement with the cartridge.

26 Claims, 5 Drawing Sheets

(56) References Cited

U.S. PATENT DOCUMENTS

| | | | | |
|---|---|---|---|---|
| 2014/0137454 | A1* | 5/2014 | Lee | F41A 15/14<br>42/25 |
| 2014/0196339 | A1* | 7/2014 | Zukowski | F41A 3/12<br>42/25 |
| 2015/0128468 | A1 | 5/2015 | Doiron | |

FOREIGN PATENT DOCUMENTS

| | | | | | |
|---|---|---|---|---|---|
| DE | 739617 | C | * | 9/1943 | F41A 15/14 |
| FR | 879942 | A | * | 3/1943 | F41A 15/14 |
| GB | 191104605 | | | 5/1911 | |
| GB | 19132281 | | | 5/1914 | |
| GB | 222784 | | | 10/1924 | |
| WO | 9216810 | | | 10/1992 | |

* cited by examiner

FIG.2
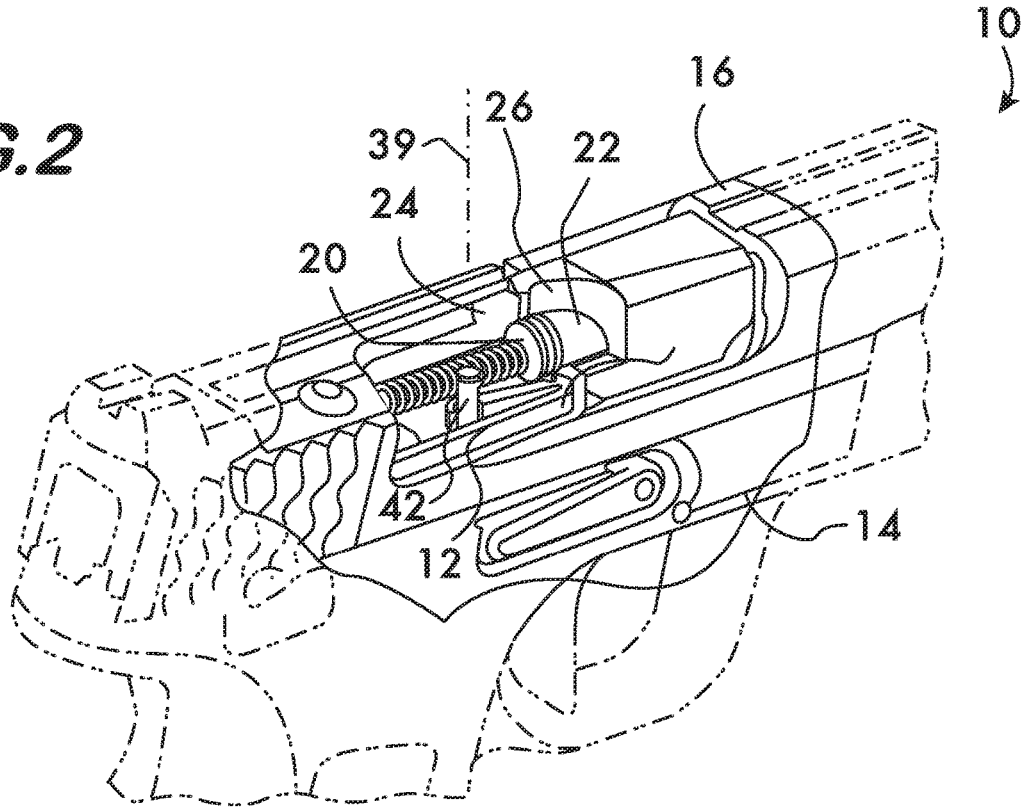
FIG.3
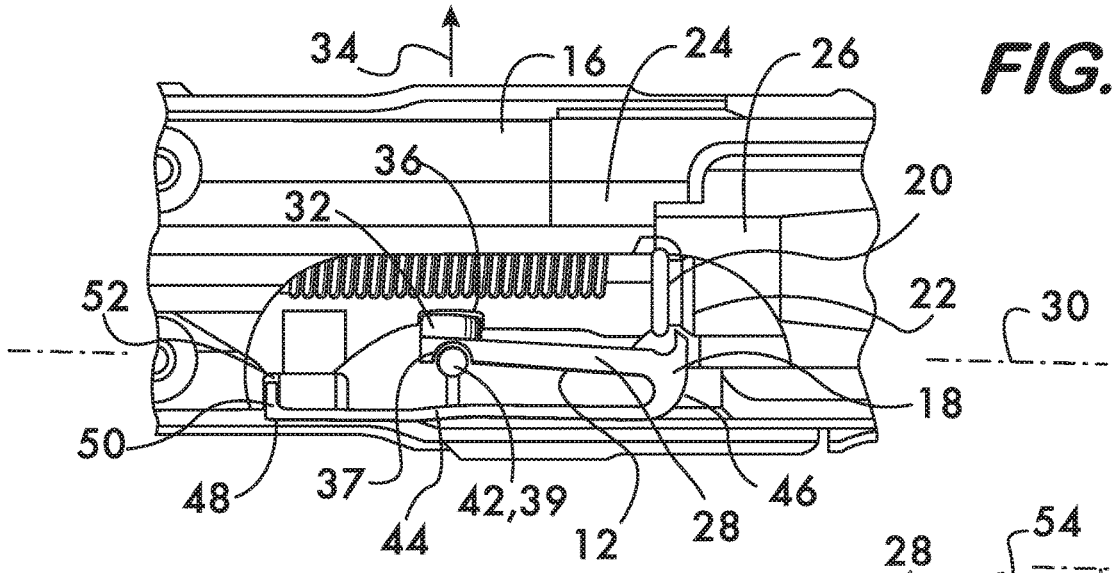
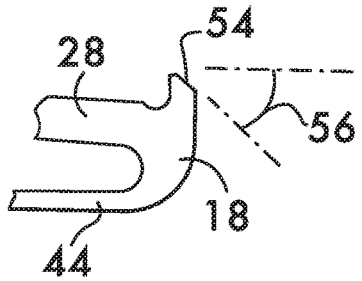
FIG.3A

CARTRIDGE EXTRACTOR

CROSS REFERENCE TO RELATED APPLICATIONS

This application is based upon and claims benefit of Priority to U.S. Provisional Application No. 62/821,065, filed Mar. 20, 2019, which application is hereby incorporated by reference herein.

FIELD OF THE INVENTION

This invention relates to cartridge extractors for use in semiautomatic firearms.

BACKGROUND

Reliable extractor operation is important for uninterrupted cycling of semiautomatic firearms. Malfunctioning extractors may be responsible for a range of stoppages, including failure to extract a spent cartridge and failure to eject a spent cartridge, the notorious "stovepipe" jam being an example of the latter. Failure to extract is very serious as it may not be possible to quickly clear the firearm by merely cycling the action. There are thus opportunities to improve the reliability of extractor operation and thereby reduce the frequency of stoppages due to extractor malfunctions. One approach is to reduce the number of parts associated with the extractor such as the elimination of discrete biasing springs for biasing the extractor into engagement with the cartridge casing.

SUMMARY

The invention concerns an extractor mountable on a slide of a firearm for extracting a chambered cartridge. In an example embodiment the extractor comprises a hook for engaging the cartridge. An elongated strap extends from the hook. A projection is mounted on the strap distal to the hook. The projection extends in a first direction transversely to a longitudinal axis of the strap. A leg has a first end attached to the strap. The leg extends lengthwise along the strap in spaced apart relation thereto. In a particular example embodiment the strap defines a notch. The notch is positioned distal to the hook and in facing relation to the leg. By way of example the notch may be positioned adjacent to the projection. In another example embodiment the strap defines an opening therethrough. The opening is positioned distal to the hook. The opening has a bore axis oriented transversely to the longitudinal axis of the strap and the first direction. By way of example the opening may comprise a slot. In an example embodiment the opening is positioned adjacent to the projection.

In a further example embodiment the first end of the leg is attached to the strap adjacent to the hook. Also by way of example the extractor comprises a spur positioned at a second end of the leg oppositely disposed to the first end. The spur extends in a direction parallel to the first direction. An example embodiment comprises a ramp surface positioned on the hook. The ramp surface is angularly oriented with respect to the longitudinal axis of the strap. A further example embodiment comprises a beam having a first end attached to the leg and a second end oppositely disposed. The second end defines an opening therethrough, the opening having a bore axis oriented transversely to the longitudinal axis of the strap and the first direction. In an example embodiment the second end of the beam is positioned adjacent to the projection. By way of example the first end of the beam is attached to the leg proximate to a second end thereof oppositely disposed to the first end.

The invention also encompasses a firearm for shooting a chambered cartridge. An example firearm embodiment according to the invention comprises a frame. A slide is mounted on the frame and is movable between a position in battery and a position out of battery. An extractor is pivotably mounted on the slide for extracting the chambered cartridge when the slide moves out of battery. In an example embodiment the extractor comprises a hook for engaging the cartridge. An elongated strap extends from the hook. A projection is mounted on the strap distal to the hook. The projection extends in a first direction transversely to a longitudinal axis of the strap. The projection is received within a recess defined by the slide. A leg has a first end attached to the strap. The leg extends lengthwise along the strap in spaced apart relation thereto. The leg has a second end oppositely disposed from the first end. The second end of the leg engages the slide.

In a particular example embodiment the strap defines a notch. The notch is positioned distal to the hook and in facing relation to the leg. By way of example the notch may be positioned adjacent to the projection. In another example embodiment the strap defines an opening therethrough. The opening is positioned distal to the hook. The opening has a bore axis oriented transversely to the longitudinal axis of the strap and the first direction. By way of example the opening may comprise a slot. In an example embodiment the opening is positioned adjacent to the projection.

In a further example embodiment the first end of the leg is attached to the strap adjacent to the hook. Also by way of example the extractor comprises a spur positioned at a second end of the leg oppositely disposed to the first end. The spur extends in a direction parallel to the first direction. An example embodiment comprises a ramp surface positioned on the hook. The ramp surface is angularly oriented with respect to the longitudinal axis of the strap. A further example embodiment comprises a beam having a first end attached to the leg and a second end oppositely disposed. The second end defines an opening therethrough, the opening having a bore axis oriented transversely to the longitudinal axis of the strap and the first direction. In an example embodiment the second end of the beam is positioned adjacent to the projection. By way of example the first end of the beam is attached to the leg proximate to a second end thereof oppositely disposed to the first end.

BRIEF DESCRIPTION OF THE DRAWINGS

FIG. 2 is an isometric partially cut-away view of the firearm shown in FIG. 1;

FIG. 3 is a partially cut-away top view of a portion of the firearm shown in FIG. 1;

FIG. 3A is a view of a component from FIG. 3 shown on an enlarged scale;

DETAILED DESCRIPTION

Figure 1:
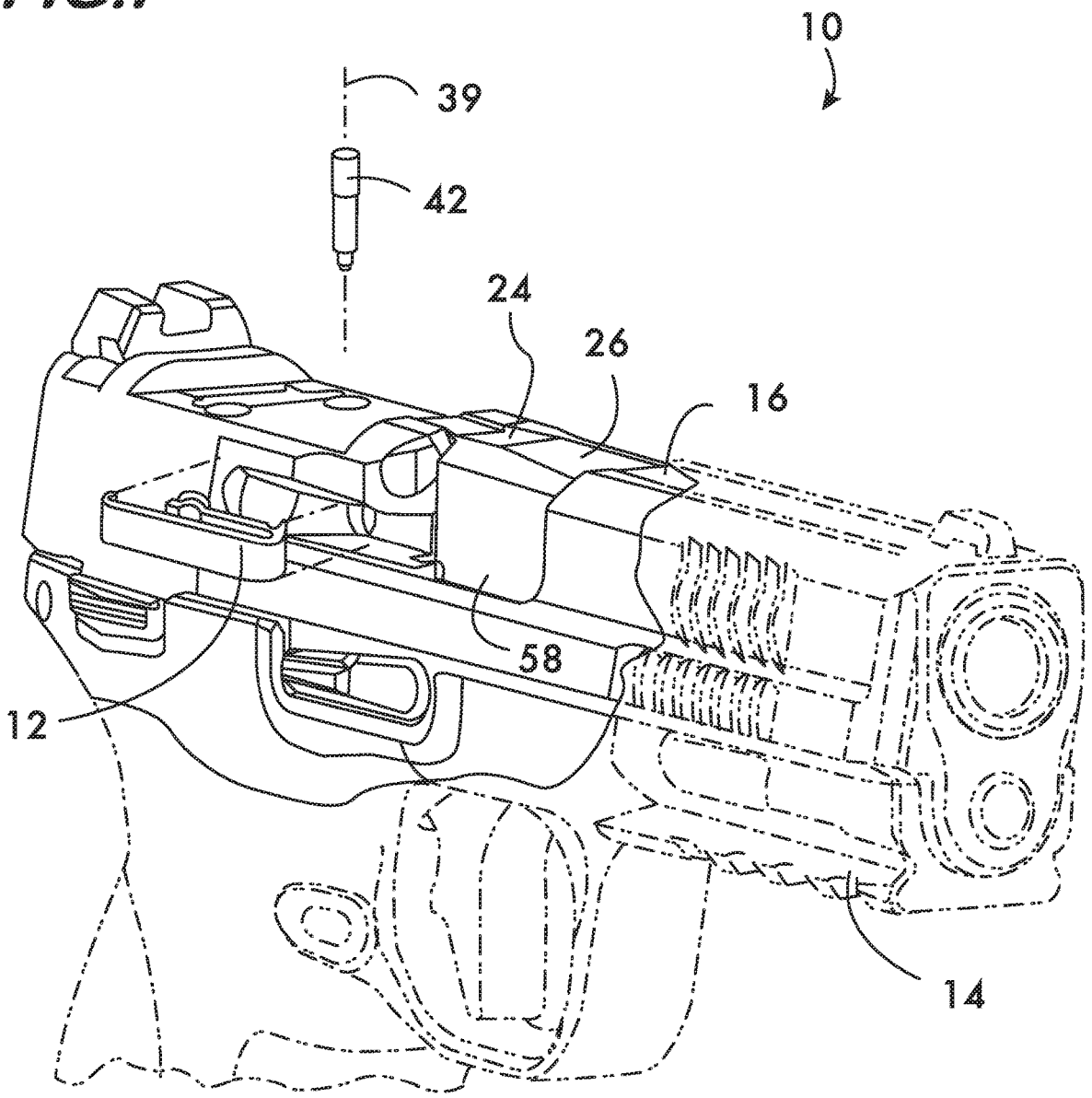
FIG. 1 is an isometric exploded view of an example firearm and extractor according to the invention.

FIG. 1 is an exploded view of a firearm 10 having an example extractor 12 according to the invention. Firearm 10, in this example a semiautomatic pistol, comprises a frame 14 on which a slide 16 is movably mounted. Slide 16 is slidably movable lengthwise along the frame 14 between a closed position (shown), known as "in battery", and an open position, known as "out of battery". Slide 16 cycles in and out of battery during operation of the firearm 10 to extract a spent cartridge casing and chamber a fresh cartridge which it strips from the firearm's ammunition magazine as is well understood. The slide 16 may also be cycled manually to extract and/or chamber a live cartridge. Extraction of the cartridge from the firing chamber is effected by the extractor 12 mounted on the slide 16. For simplicity the term "cartridge" is used herein to refer to both a live cartridge as well as a spent cartridge casing.

As shown in FIGS. 2 and 3, the example extractor 12 according to the invention comprises a hook 18. When the slide 16 is in battery (shown), hook 18 is positioned between the breech block 24 and the barrel chamber 26 and engages the rim 20 (in this example, a rebated rim) of a cartridge 22 in the chamber 26. As shown in FIG. 3, an elongated strap 28 extends from the hook 18. Strap 28 defines a longitudinal axis 30 which, in this example, extends in a direction substantially parallel to the line of motion of the slide 16. A projection 32 is mounted on the strap 28 distal to the hook 18. Projection 32 extends in a first direction 34 oriented transversely to the longitudinal axis 30 of the strap 28 and is received within a recess 36 defined by the slide 16. Engagement between the projection 32 and the slide 16 causes the extractor 12 to remain with the slide 16 as it moves out of battery (motion to the left along axis 30 in FIG. 3), and engagement between the hook 18 and the cartridge rim 20 subsequently extracts the cartridge 22 from the chamber 26. In the example embodiment shown in FIGS. 2 and 3, the strap 28 defines a notch 37. Notch 37 is positioned distal to hook 18 and in facing relation with a leg 44 (described below). It is advantageous to position notch 37 adjacent to the projection 32. A pin 42 (see also FIG. 1) mounted on the slide 16 engages the notch 37 and retains the strap 28 to the slide. Engagement between the pin 42 and the notch 37 allows pivoting motion of the strap 28 about the longitudinal axis 39 of pin 42. Pivoting motion of the strap 28 permits the hook 18 to deflect and engage the rim 20 of a chambered cartridge 22 as the slide moves into battery as described below.

As further shown in FIG. 3 the extractor 12 also comprises a leg 44. Leg 44 has a first end 46 attached to the strap 28, in this example, the leg is attached adjacent to the hook 18. Leg 44 extends lengthwise along and in spaced apart relation to the strap 28. Leg 44 has a second end 48 oppositely disposed from the first end 46, the second end 48 engaging the slide 16. In this example embodiment a spur 50 is positioned at the second end 48 of the leg 44. Spur 50 extends in a direction substantially parallel to the first direction 34 in which the projection 32 extends. Spur 50 is received within a receptacle 52 in the slide 16 and anchors the second end of the leg 44, which thereby acts as a biasing spring when the strap 28 pivots on pin 42 about the pin axis 39. As shown in FIG. 3A, the extractor 12 further comprises a ramp surface 54 positioned on the hook 18. Ramp surface 54 is angularly oriented with respect to the longitudinal axis 30 of the strap 28. The orientation angle 56 is arranged so that the hook 18 pivots away from the cartridge 22 when the ramp surface 54 engages the cartridge as the slide 16 moves into battery (motion to the right in FIG. 3).

Figure 4:
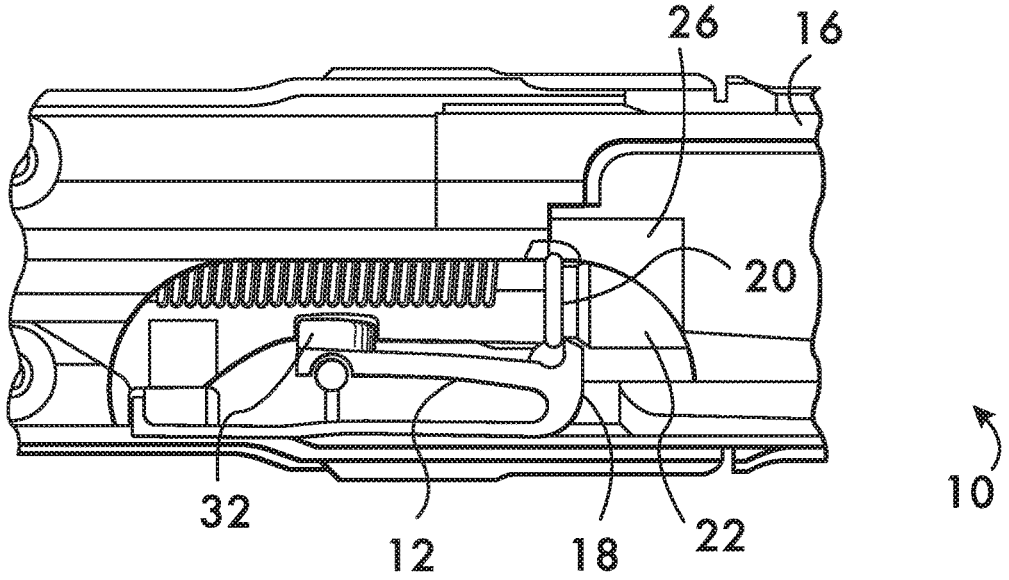
FIGS. 4 and 5 are partially cut-away top views illustrating operation of the firearm shown in FIG. 1.
Figure 5:
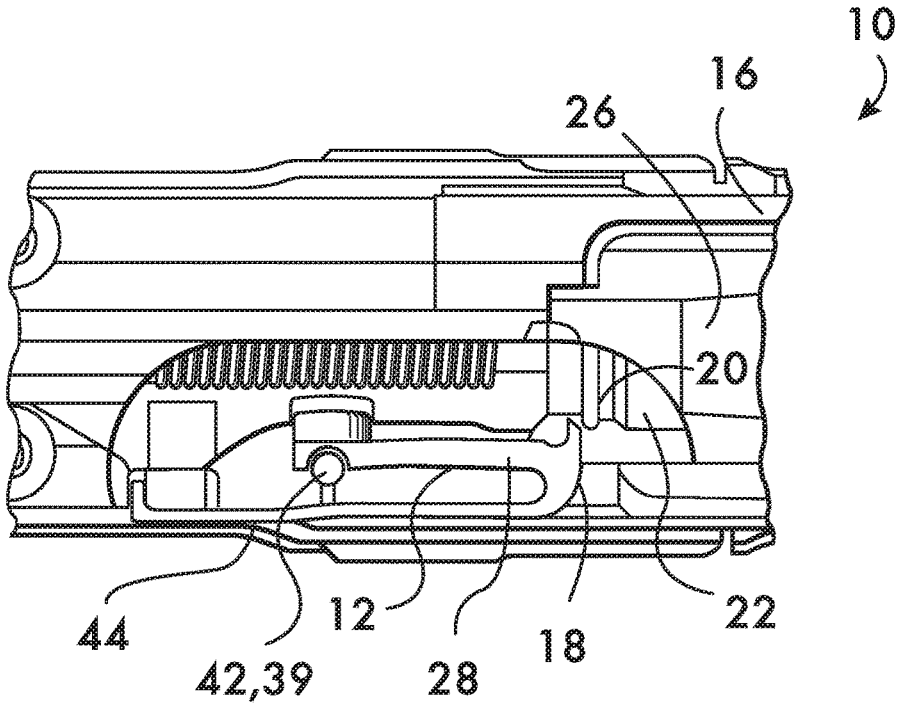

Operation of the extractor 10 is described with reference to FIGS. 4 and 5. As shown in FIG. 4, the slide 16 is in battery, a cartridge 22 is chambered, and the hook 18 engages the rebated rim 20. As the slide 16 moves out of battery (motion to the left), the hook 18 moves with the slide by virtue of the engagement between the projection 32 and the slide 16, thereby drawing the cartridge 22 out of the chamber 26. Once it clears the chamber 26 the cartridge will hit an ejector (not shown) which flips it out and away from the firearm 10 through an ejector port 58 in the slide (see FIG. 1). With reference to FIG. 5, as the slide 16 returns to battery it strips and chambers another cartridge 22. As the cartridge 22 is seated in the chamber 26 the ramp surface 54 (see FIG. 3A) engages the rim 20 of the cartridge. The orientation angle 56 of the ramp surface causes the strap 28 to pivot clockwise on pin 42 about the pin axis 39, thereby allowing the hook to pass over the rim 20. The pivoting motion of the strap 28 bends the leg 44, which acts as a spring to bias the hook 18 toward the cartridge 22. Once the hook 18 clears the rim 20 it snaps into engagement with the rim under the biasing force of the leg 44 as depicted in FIG. 4.

Figure 6:
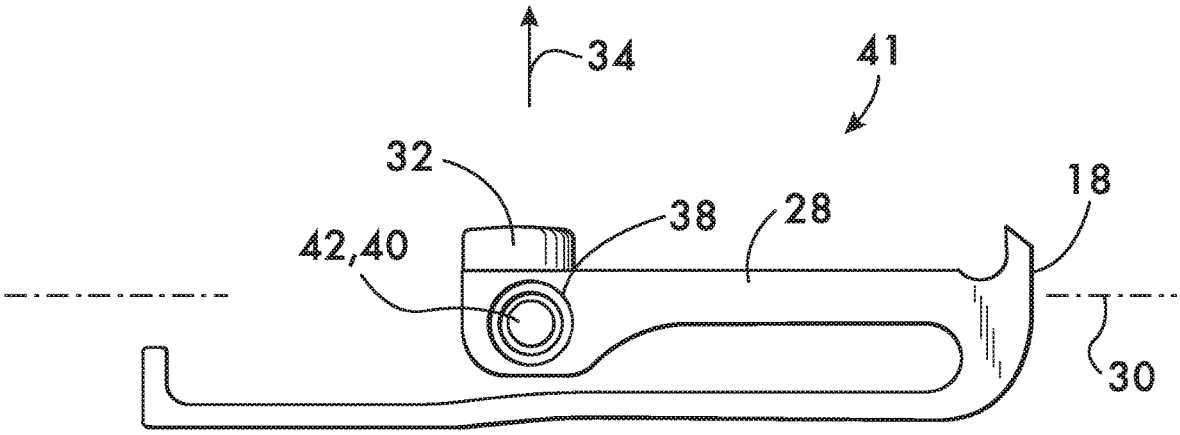
FIG. 6 is a top view of another example embodiment of an extractor according to the invention.

In another example extractor embodiment 41, shown in FIG. 6, the strap 28 defines an opening 38 which has a bore axis 40 oriented transversely to both the longitudinal axis 30 of the strap 28 and the first direction 34 in which the projection 32 extends. In this example embodiment the opening 38 is positioned distal to the hook 18, advantageously adjacent to the projection 32 and may comprise a slot to permit additional free play and more reliable engagement between hook and cartridge. When extractor 41 is used in firearm 10 (FIG. 1), pin 42, mounted on the slide 16, extends through the opening 38. Pin 42 thus retains the strap 28 to the slide and allows pivoting motion of the strap about the bore axis 40. Pivoting motion of the strap 28 permits the hook 18 to deflect and engage the rim 20 of a chambered cartridge 22 as the slide moves into battery as described above.

Figure 7:
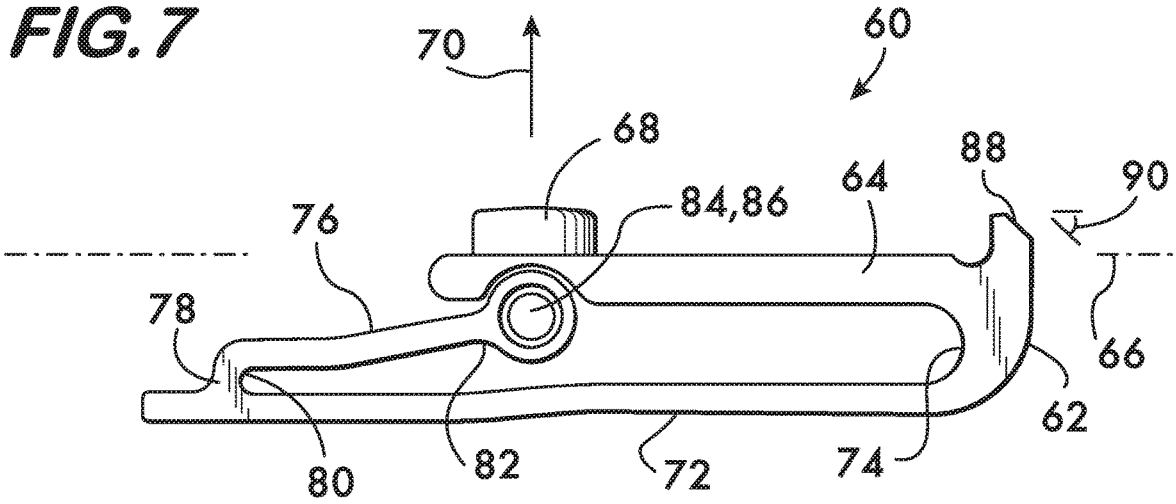
FIG. 7 is a top view of another example embodiment of an extractor according to the invention.

FIG. 7 shows another example embodiment of an extractor 60 according to the invention. Extractor 60 comprises a hook 62 for engaging a cartridge 22, the hook 62 being positioned between the breech block 24 and the barrel chamber 26 when extractor 60 is mounted on firearm 10 (FIG. 1). An elongated strap 64 extends from the hook 62 and defines a longitudinal axis 66 which extends parallel to the line of motion of the slide 16. A projection 68 is mounted on the strap 64 distal to the hook 62. Projection 68 extends in a first direction 70 oriented transversely to the longitudinal axis 66 of the strap 64 and is received within the recess 36 defined by the slide 16. Engagement between the projection 68 and the slide 16 causes the extractor 60 to remain with the slide 16 as it moves out of battery (motion to the left in FIG. 7) to extract the cartridge 22 from the chamber 26.

As further shown in FIG. 7, extractor 60 comprises a leg 72. Leg 72 has a first end 74 attached to the strap 64, in this example adjacent to the hook 62. Leg 72 extends lengthwise along and in spaced apart relation to the strap 64. Example extractor 60 further comprises a beam 76. A first end 78 of beam 76 is attached to the leg 72. In this example embodiment attachment of the beam 76 to the leg 72 is proximate to the second end 80 of the leg oppositely disposed to the leg's first end 74. Beam 76 has a second end 82 oppositely disposed from the beam's first end, the second end 82 defining an opening 84 therethrough. In this example opening 84 has a round cross sectional shape, but other shapes, such as a slotted cross section are also feasible. Opening 84 has a bore axis 86 oriented transversely to both the longitudinal axis 66 of the strap 64 and the first direction 70 in which the projection 68 extends. When extractor 60 is mounted on Firearm 10 (see FIG. 1), pin 42, mounted on slide 16, extends through opening 84 and retains the extractor 60 to the slide. Extractor 60 pivots about the bore axis 86 on the pin 42. It is advantageous that the opening 84 be positioned adjacent to the projection 68 and that the second end 80 of the leg 72 be engageable with and react against the slide 16. This configuration allows the beam 76 to act as a spring to bias the hook 62 toward the cartridge 22. Hook 62 also comprises a ramp surface 88 oriented transversely to the longitudinal axis 66 of the strap 64. The orientation angle 90 is arranged so that the hook 62 pivots away from the cartridge 22 as the slide 16 moves into battery.

Figure 8:
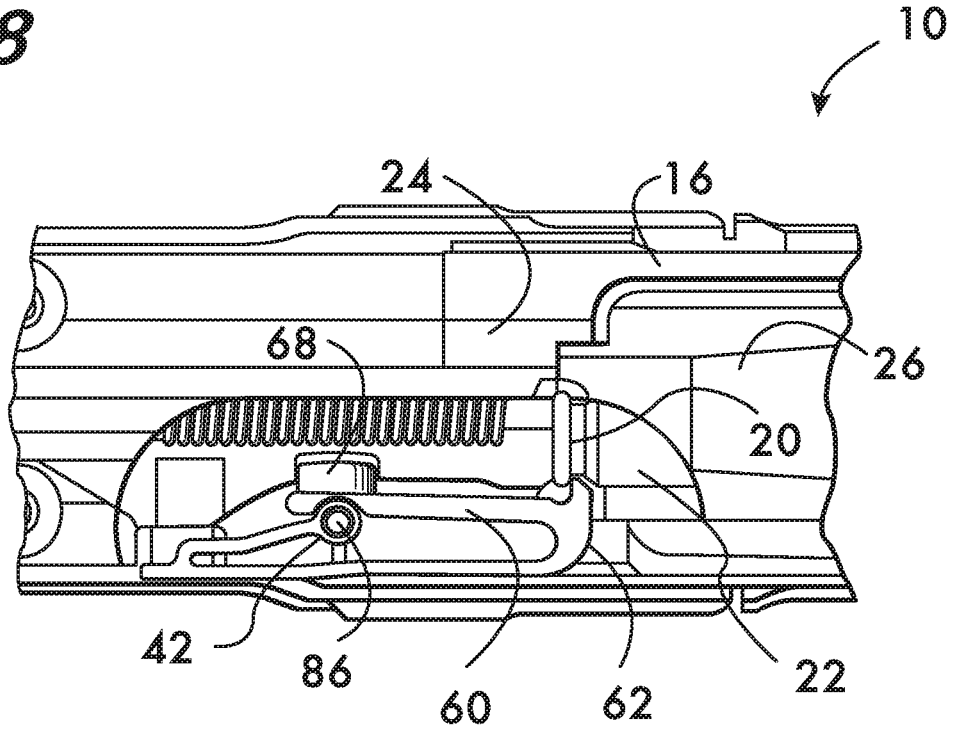
FIGS. 8 and 9 are partially cut-away top views illustrating operation of the firearm using the example extractor embodiment of FIG. 7.
Figure 9:
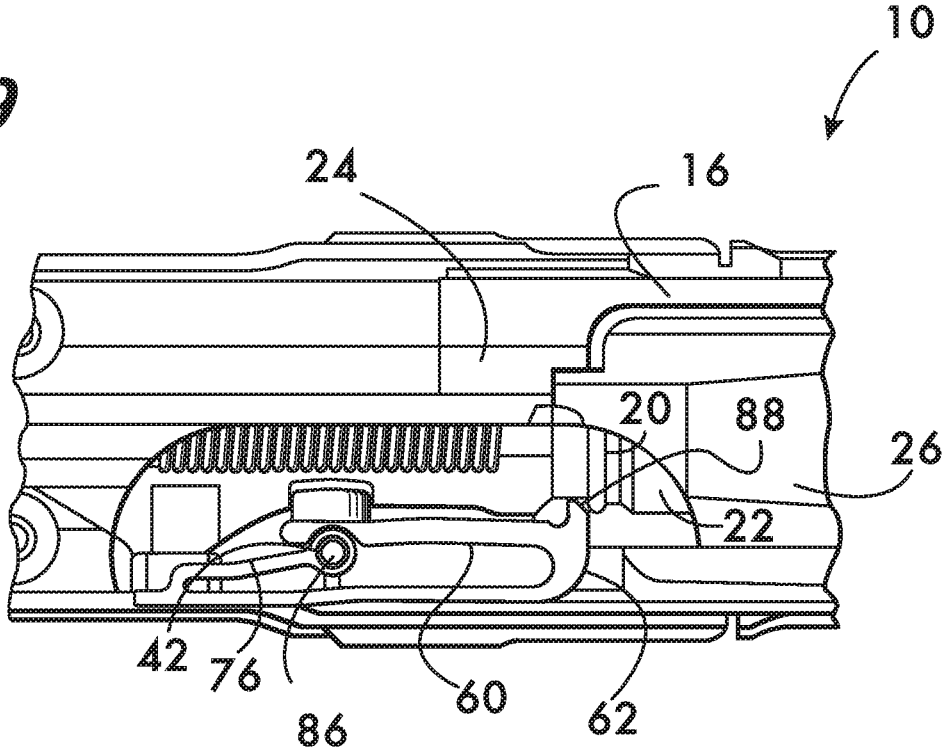

Operation of the extractor 60 is described with reference to FIGS. 8 and 9. As shown in FIG. 8, the slide 16 is in battery, a cartridge 22 is chambered, and the hook 62 engages the rebated rim 20. As the slide 16 moves out of battery (motion to the left), the hook 62 moves with the slide by virtue of the engagement between the projection 68 and the slide 16, thereby drawing the cartridge 22 out of the chamber 26. Once it clears the chamber 26 the cartridge will hit an ejector (not shown) which flips it out and away from the firearm 10 through an ejector port 58 in the slide (see FIG. 1). With reference to FIG. 9, as the slide 16 returns to battery (motion to the right) it strips and chambers another cartridge 22. As the cartridge 22 is seated in the chamber 26 the ramp surface 88 engages the rim 20 of the cartridge. The orientation angle 90 (see FIG. 7) of the ramp surface 88 causes the extractor 60 to pivot clockwise on pin 42 about the bore axis 86, thereby allowing the hook 62 to pass over the rim 20. The pivoting motion of the extractor 60 bends the beam 76, which acts as a spring to bias the hook 62 toward the cartridge 22. Once the hook clears the rim it snaps into engagement with the rebated rim under the biasing force of the beam 76 as depicted in FIG. 8.

It is expected that extractors according to the invention will result in more reliable extraction of spent cartridges, thereby improving the reliability of semiautomatic firearms.

What is claimed is:

1. An extractor mountable on a slide of a firearm for extracting a chambered cartridge, said extractor comprising:
- a hook for engaging said cartridge;
- an elongated strap extending from said hook;
- a projection mounted on said strap distal to said hook, said projection extending in a first direction transversely to a longitudinal axis of said strap;
- a leg having a first end attached to said strap, said leg extending lengthwise along said strap in spaced apart relation thereto, said first end of said leg being attached to said strap adjacent to said hook.

2. The extractor according to claim 1, wherein said strap defines a notch, said notch being positioned distal to said hook and in facing relation to said leg.

3. The extractor according to claim 2, wherein said notch is positioned adjacent to said projection.

4. The extractor according to claim 1, wherein said strap defines an opening therethrough, said opening being positioned distal to said hook, said opening having a bore axis oriented transversely to said longitudinal axis of said strap and said first direction.

5. The extractor according to claim 4, wherein said opening comprises a slot.

6. The extractor according to claim 4, wherein said opening is positioned adjacent to said projection.

7. The extractor according to claim 1, further comprising a spur positioned at a second end of said leg oppositely disposed to said first end.

8. The extractor according to claim 7, wherein said spur extends in a direction parallel to said first direction.

9. The extractor according to claim 1, further comprising a ramp surface positioned on said hook, said ramp surface being angularly oriented with respect to said longitudinal axis of said strap.

10. The extractor according to claim 1, further comprising a beam having a first end attached to said leg and a second end oppositely disposed, said second end defining an opening therethrough, said opening having a bore axis oriented transversely to said longitudinal axis of said strap and said first direction.

11. The extractor according to claim 10, wherein said second end of said beam is positioned adjacent to said projection.

12. The extractor according to claim 10, wherein said first end of said beam is attached to said leg proximate to a second end thereof oppositely disposed to said first end.

13. A firearm for shooting a chambered cartridge, said firearm comprising:
- a frame;
- a slide mounted on said frame and movable between a position in battery and a position out of battery;
- an extractor pivotably mounted on said slide for extracting said chambered cartridge when said slide moves out of battery, said extractor comprising:
- a hook for engaging said cartridge;
- an elongated strap extending from said hook;
- a projection mounted on said strap distal to said hook, said projection extending in a first direction transversely to a longitudinal axis of said strap, said projection being received within a recess defined by said slide;
- a leg having a first end attached to said strap, said leg extending lengthwise along said strap in spaced apart relation thereto, said leg having a second end oppositely disposed from said first end, said second end of said leg engaging said slide.

14. The firearm according to claim 13, wherein said strap defines a notch, said notch being positioned distal to said hook and in facing relation with said leg, said extractor further comprising a pin mounted on said slide, said pin engaging said notch for retaining said strap to said slide, said strap being pivotably movable on said pin.

15. The firearm according to claim 14, wherein said notch is positioned adjacent to said projection.

16. The firearm according to claim 13, wherein said strap defines an opening therethrough, said opening being positioned distal to said hook, said opening having a bore axis oriented transversely to said longitudinal axis of said strap and said first direction, said extractor further comprising a pin mounted on said slide, said pin extending through said opening for retaining said strap to said slide, said strap being pivotably movable on said pin about said bore axis.

17. The firearm according to claim 16, wherein said opening comprises a slot.

18. The firearm according to claim 16, wherein said opening is positioned adjacent to said projection.

19. The firearm according to claim 13, wherein said first end of said leg is attached to said strap adjacent to said hook.

20. The firearm according to claim 13, further comprising a spur positioned at a second end of said leg oppositely disposed to said first end, said spur being received within a receptacle in said slide.

21. The firearm according to claim 13, further comprising a ramp surface positioned on said hook, said ramp surface being angularly oriented with respect to said longitudinal axis of said strap.

22. The firearm according to claim 13, further comprising a beam having a first end attached to said leg and a second end oppositely disposed, said second end defining an opening therethrough, said opening having a bore axis oriented transversely to said longitudinal axis of said strap and said first direction, said extractor further comprising a pin mounted on said slide, said pin extending through said opening for retaining said strap to said slide, said strap being pivotably movable on said pin about said bore axis.

23. The firearm according to claim 22, wherein said second end of said beam is positioned adjacent to said projection.

24. The firearm according to claim 22, wherein said first end of said beam is attached to said leg proximate to a second end thereof oppositely disposed to said first end.

25. An extractor mountable on a slide of a firearm for extracting a chambered cartridge, said extractor comprising:

a hook for engaging said cartridge;

an elongated strap extending from said hook;

a projection mounted on said strap distal to said hook, said projection extending in a first direction transversely to a longitudinal axis of said strap;

a leg having a first end attached to said strap, said leg extending lengthwise along said strap in spaced apart relation thereto;

a spur positioned at a second end of said leg oppositely disposed to said first end.

26. The extractor according to claim 25, wherein said spur extends in a direction parallel to said first direction.

* * * * *